United States Patent [19]

Focke

[11] Patent Number: 4,629,446

[45] Date of Patent: Dec. 16, 1986

[54] APPARATUS FOR ERECTING FOLDING BOXES

[75] Inventor: Heinz Focke, Verden, Fed. Rep. of Germany

[73] Assignee: Focke & Co., (GmbH & Co.), Fed. Rep. of Germany

[21] Appl. No.: 757,419

[22] Filed: Jul. 22, 1985

[30] Foreign Application Priority Data

Aug. 13, 1984 [DE] Fed. Rep. of Germany ..... 3429761

[51] Int. Cl.[4] ..... B31B 1/80

[52] U.S. Cl. ..... 493/317; 271/91

[58] Field of Search ..... 493/316, 317, 123, 125; 271/91, 95, 99

[56] References Cited

U.S. PATENT DOCUMENTS 3,298,289 1/1967 Szabo ..... 493/316

3,739,696 6/1973 Pearson ..... 493/316

4,348,853 9/1982 Morse et al. ..... 53/566

*Primary Examiner*—Francis S. Husar

*Assistant Examiner*—William E. Terrell

*Attorney, Agent, or Firm*—Sughrue, Mion, Zinn, Macpeak, and Seas

[57] ABSTRACT

Folding boxes (10) are held in readiness for filling in the flat folded state in magazines in conjunction with packagaing machines. An erection of the folding boxes is necessary for this purpose. For this purpose there is provided a gripping arm (33) movable pivotably and in translation and having suction cups (34), which removes the respective front folding box (10) from the magazine (19), transports it to a stationary holder, also having suction cups (38), (37) and then erects the folding box conjointly with the stationary holder.

9 Claims, 9 Drawing Figures

APPARATUS FOR ERECTING FOLDING BOXES

DESCRIPTION

Figure 1:
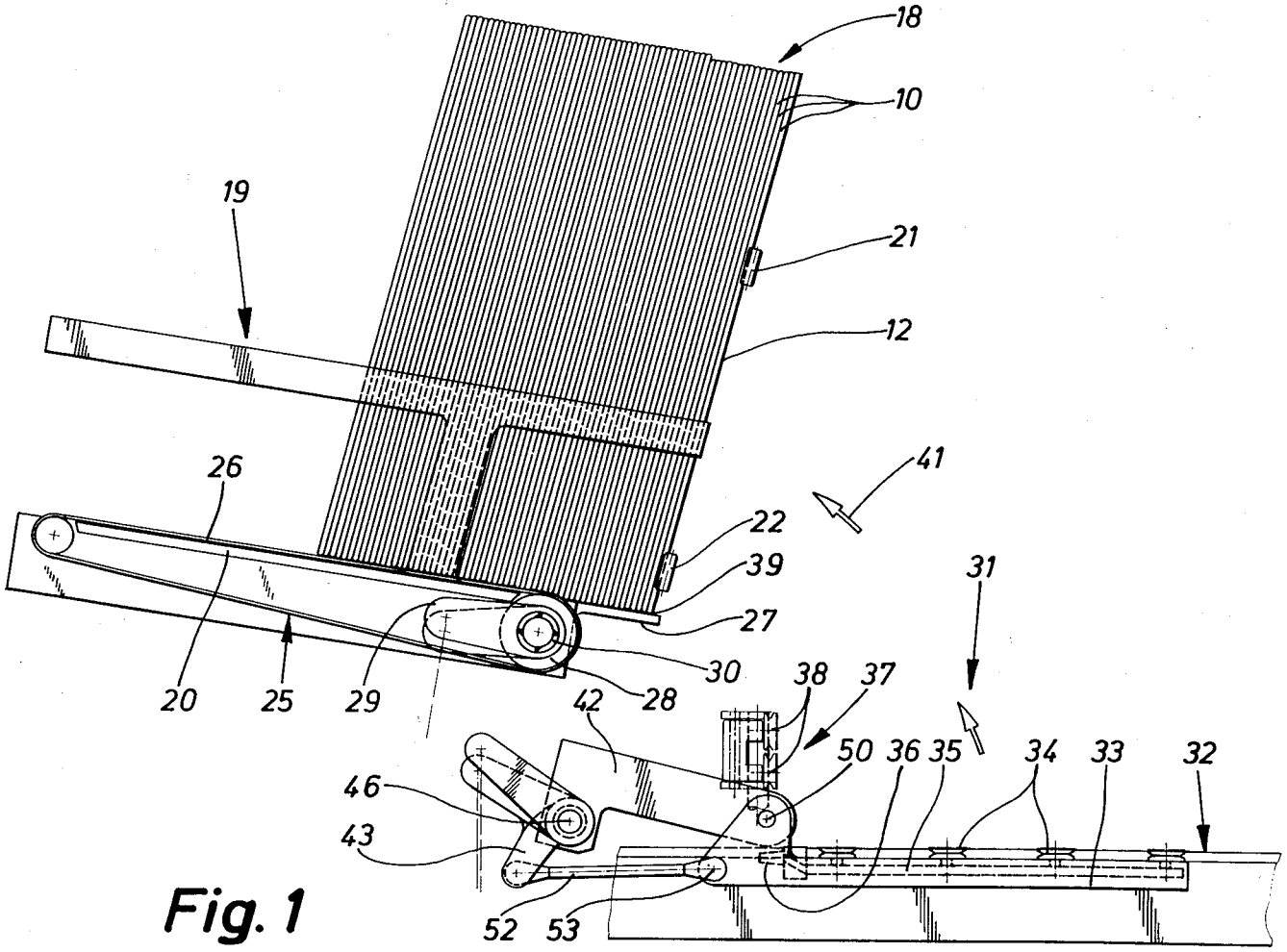

The invention relates to an apparatus for erecting folding boxes (corrugated boxes) folded flat, consisting of front wall, rear wall and side walls and folding tabs adjoining the latter, whereby the folding boxes can be removed from a magazine and erected and placed on a discharge path by a holding member engaging the front wall by suction members.

Apparatuses of this type are used in packaging technology, namely particularly for handling large boxes (corrugated boxes). The latter are prepared for the packaging operation to the extent that the vertical walls, namely front wall, rear wall and side walls, are mutually connected to form a "tube". The folding tabs adjoining the abovementioned box walls stand out laterally. It is necessary for filling purposes for this flat folded structure to be erected so that the individual box walls are arranged mutually parallel or at right angles.

The underlying object of the invention is to develop further and improve an apparatus of the type initially stated so that the folding boxes are unfolded reliably with gentle treatment on the one hand and high capacity on the other hand. The apparatus should furthermore be of simple and clear construction, and exhibit low fault-proneness.

In order to achieve this object in the apparatus according to the invention, the folding box can be removed from the magazine by the holding member (gripping arm) and can be erected by movement relative to at least one further holding member engaging another box wall (side wall).

According to the above, the essence of the invention lies in the fact that the flat boxes are removed from a magazine by a first movable holding member (gripping arm) and are erected by the latter in cooperation with a second stationary holding member on the way to deposition on the discharge path or another preferably horizontal standing surface. The apparatus is consequently very simple in construction. The distances to be travelled by the folding box are extremely short. Due to the latter being gripped in the region of a front wall on the one hand and adjacent side wall on the other hand by members preferably equipped with suction cups, inevitability in the erection of the boxes is achieved without prejudicing the latter mechanically.

According to the invention the first holding member or movable gripping arm is constructed and/or mounted in such a way that a complex movement can be executed. First of all the gripping arm is pivoted up to the front folding box of a stack in the magazine, particularly with an upward movement thereof. A translatory return movement then occurs with the folding box picked up into a position in which the folding box stands upon the discharge path by a Lower edge. Then, by an appropriate movement of the gripping arm, the folding box is brought with its side wall onto the counterholder the second holding member arranged substantially stationary. The pivoting movement of the gripping arm into the horizontal then occurs, whereby, due to the fixing of the side wall by the second holding member on the one hand and entrainment of the front wall by the gripping arm on the other hand, the box is erected and simultaneously brought into a correct position for filling and/or further transport.

The gripping arm is connected for this purpose to a special transmission, which consists in this case of two differently movable, namely pivotable, guide rods.

The magazine arranged above the discharge path is constructed so that a rhythmic feed of the folding boxes to the removal side occurs. There the folding boxes are held detachably at the sides, particularly by small holding rollers which are rotatable about a substantially vertical axis and respectively grip the lateral vertical edges of the folding boxes.

Further features of the invention relate to the construction of the holding members, of the discharge path and of the magazine.

Figure 2:
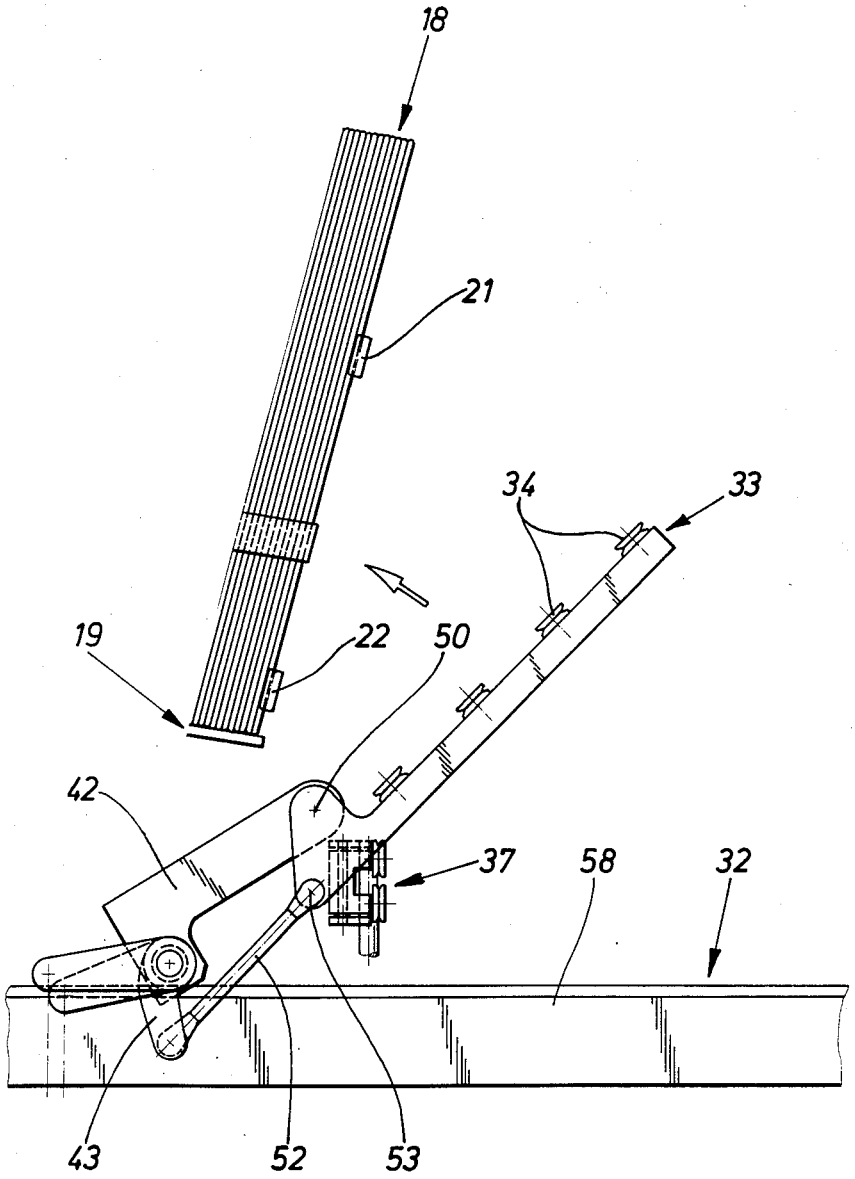
Figure 3:
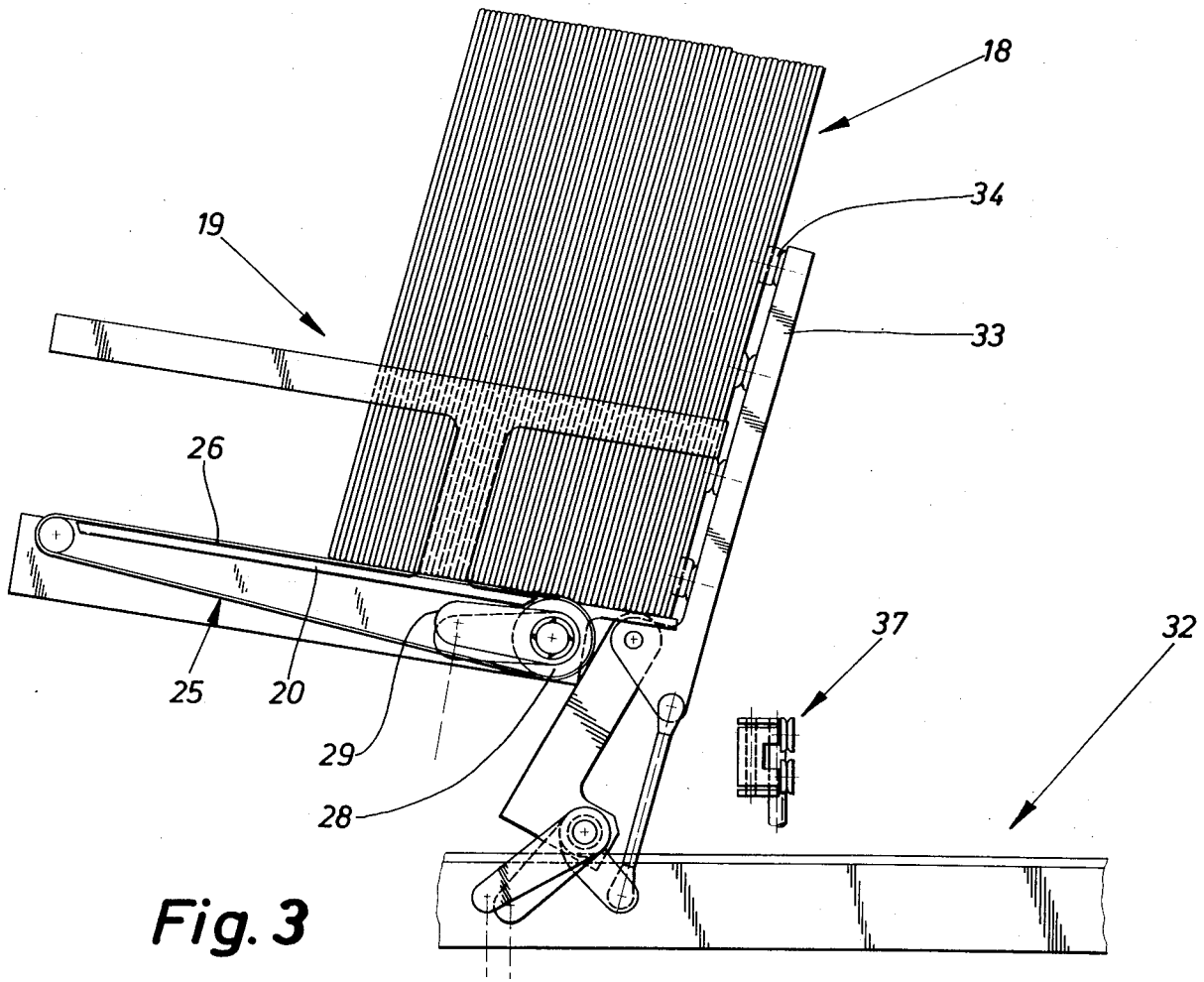
Figure 5:
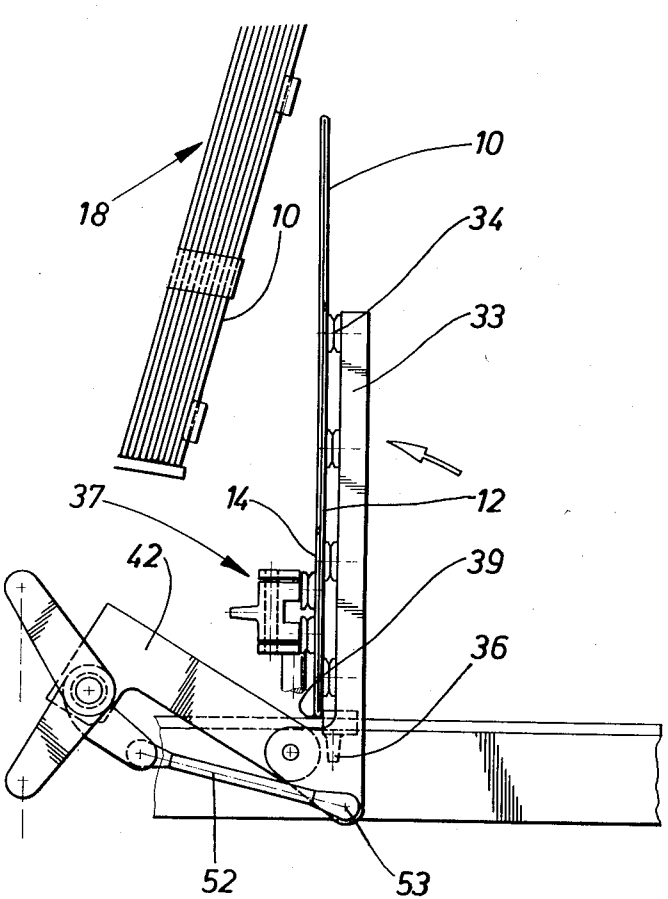
Figure 4:
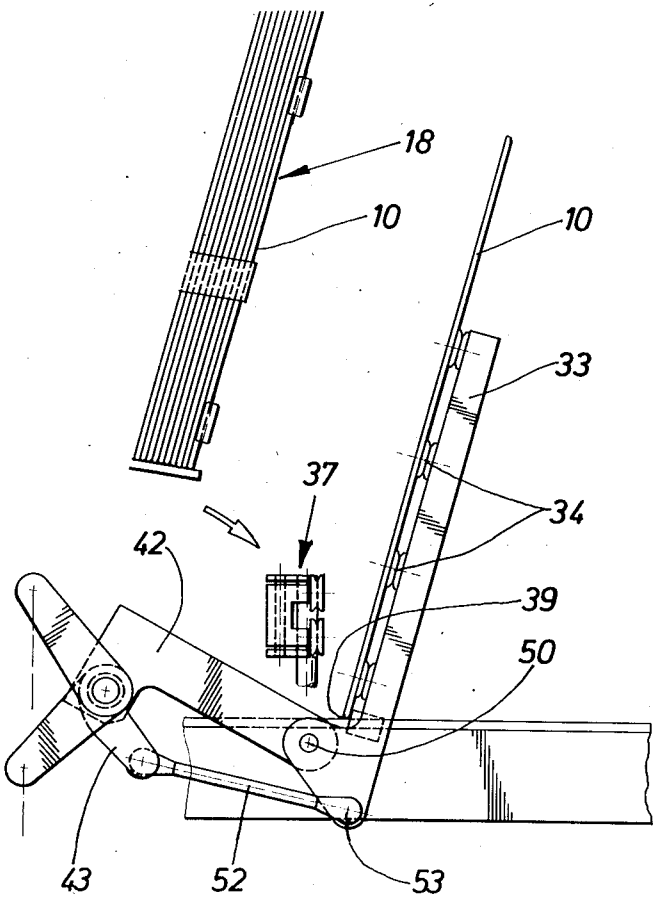
Figure 6:
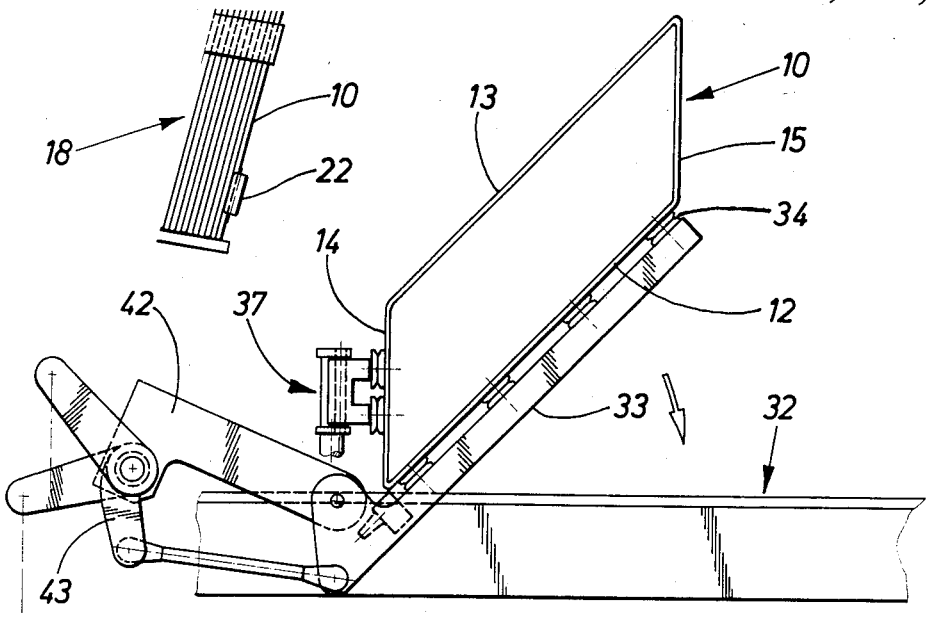
Figure 7:
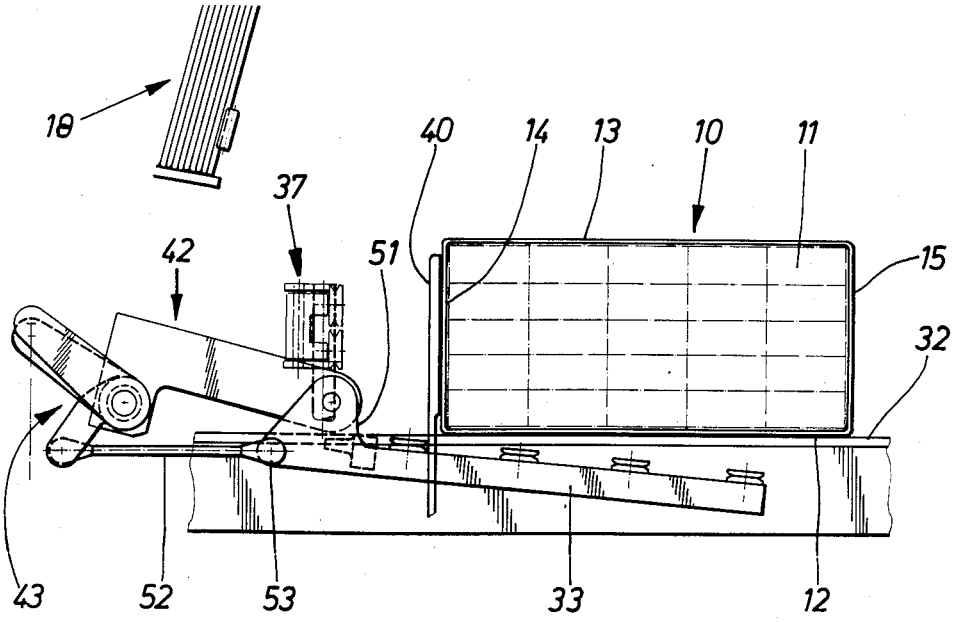
Figure 8:
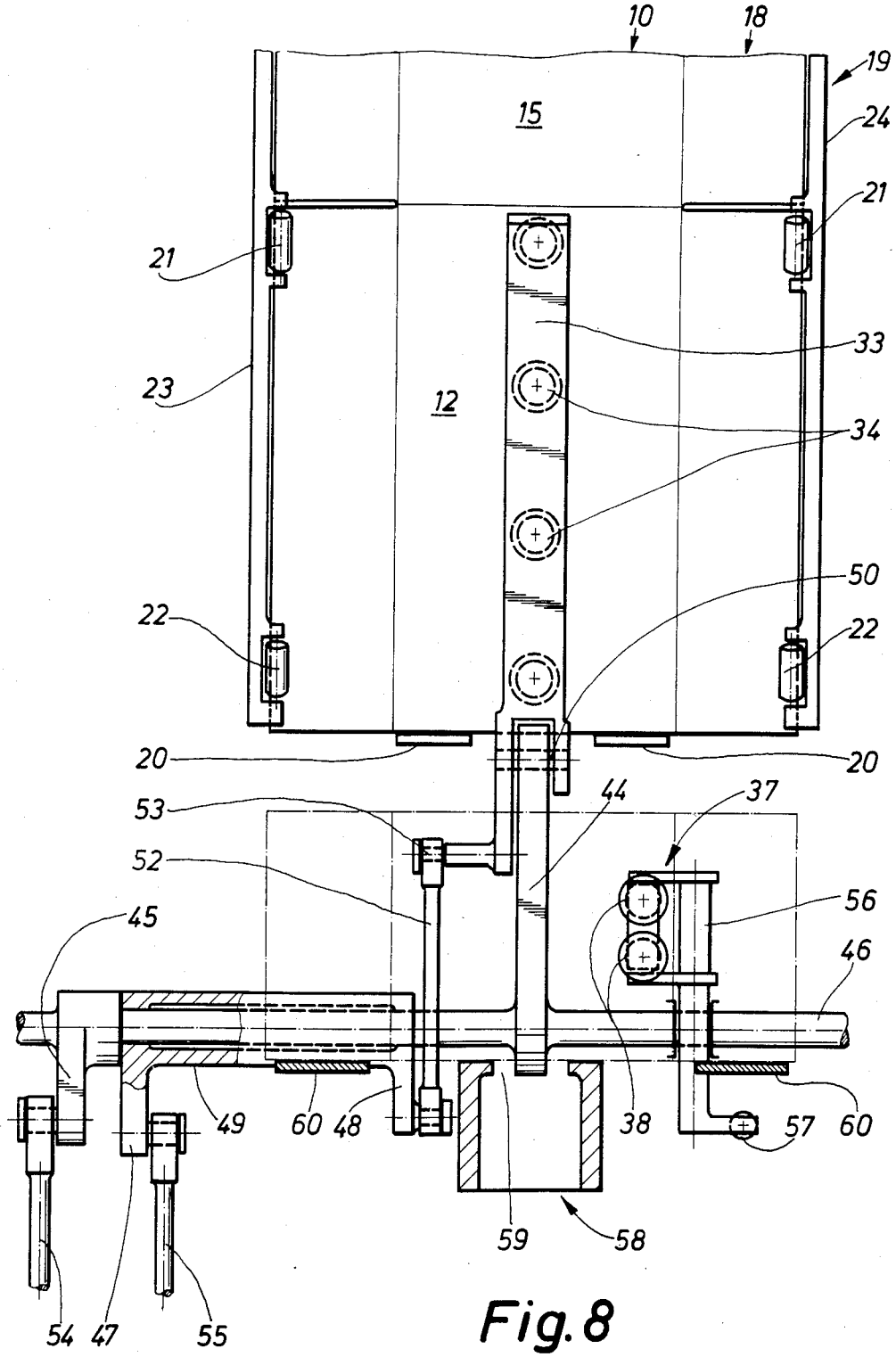
Figure 9:
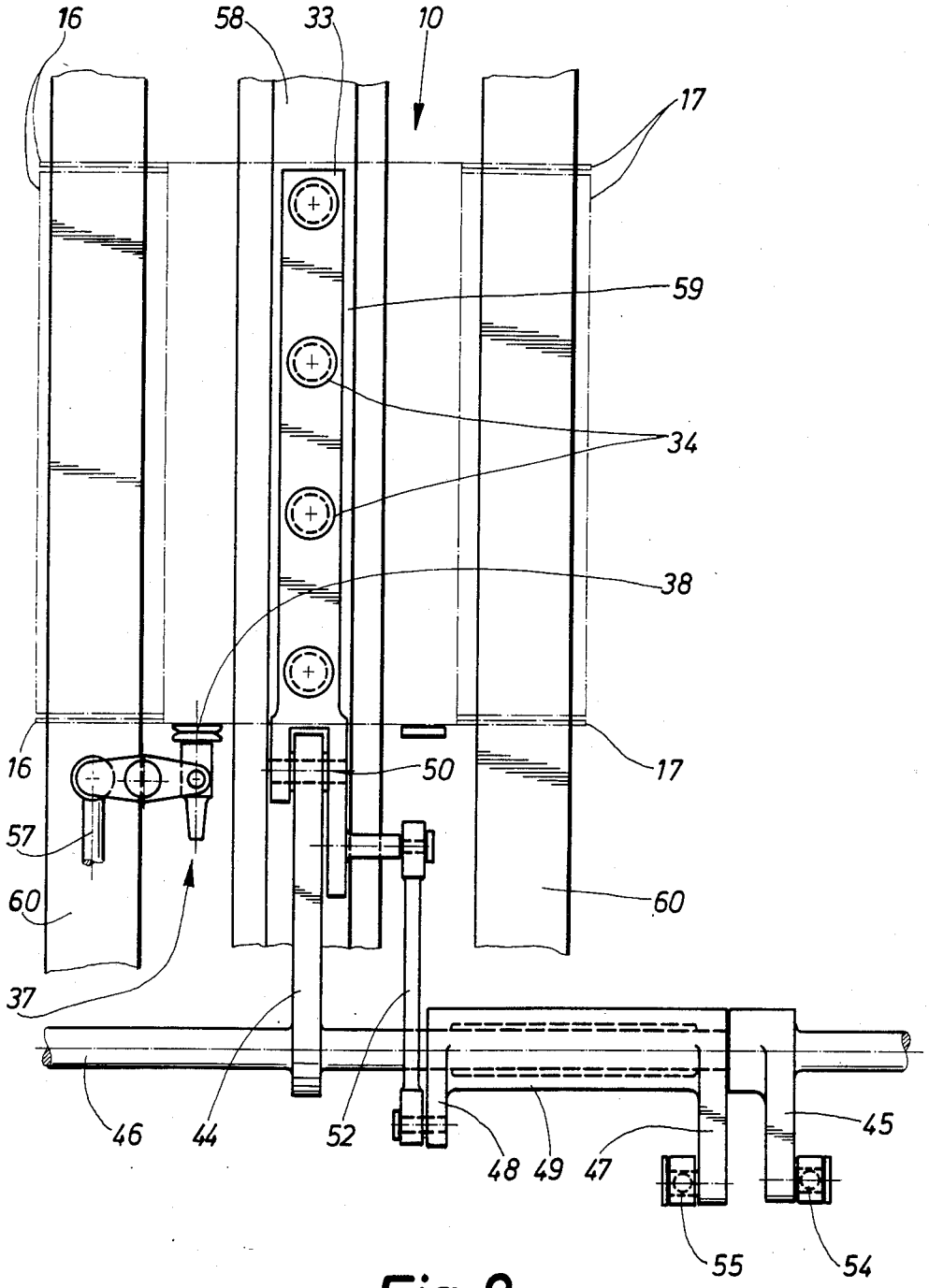

An exemplary embodiment of the invention is explained more fully below with reference to the drawings, wherein:

FIG. 1 shows the apparatus in a diagrammatic side view in an initial position of a gripping arm, FIG. 2 shows part of the apparatus according to FIG. 1 in a modified relative position of the gripping arm, FIG. 3 shows the apparatus according to FIGS. 1 and 2 during the taking of a folding box from a magazine, FIG. 4 shows the position of the gripping arm in a lowered position of the folding box, FIG. 5 shows the folding box with gripping arm, in an intermediate position, FIG. 6 shows details of the apparatus during the erection of the folding box, FIG. 7 shows the relative position of the members after the unfolding and deposition of the folding box, FIG. 8 shows the aparatus in front view and in vertical section, and FIG. 9 shows a plan view of the apparatus without the magazine.

The apparatus illustrated is used in combination with a packaging machine, or as a part of the latter. Predominantly large-volume packages, particularly corrugated boxes, are processed with such apparatuses. In the present exemplary embodiment, folding boxes 10 are produced, which serve to accommodate smaller packages, in the present case to accommodate so-called cigarette bars or cartons 11 FIG. 7).

The folding boxes 10 used here consist of front wall 12, rear wall 13, side walls 14 and 15 mutually connecting the latter, and laterally projecting folding tabs 16 and 17 adjoining the abovementioned box walls. These tabs are folded over, after the folding box 10 is filled, in order to form the top wall and bottom wall. The above definition of the box walls serves only for purposes of explanation, but does not determine the construction of the folding boxes The folding boxes 10 are prepared for processing in the packaging machine so that the (vertical) box walls, namely front wall 12, rear wall 13 and side walls 14 and 15 are mutually connected to form a "tube-like" structure (see particularly FIG. 6). The folding box 10 thus prepared is folded flat and is accommodated, in the form of a large supply 18, in a magazine 19. The folding boxes 10 are removed from the latter consecutively, namely the respective folding box located in front (on the right in FIG. 1).

In the present exemplary embodiment the magazine 19 consists of a laminar box support 20, which consists in the present case of two profile strips (FIG. 8) arranged at a mutual interval. The box support 20 is inclined slightly downwards in the transport direction. Consequently the boxes 18 are also inclined slightly forwards relative to the vertical.

At the front (removal) side of the magazine 19 the folding boxes 10 are, or the supply 18 is, retained detachably by lateral stops, so that the front folding box 10 can be removed each time without a change in the position of these stops. The stops consist in the present case of two holding rollers 21 and 22 which are mounted for rotation about vertical or approximately vertical axes on lateral vertical support stays 23 and 24. The arrangement of these holding rollers 21 and 22 is such that they protrude with a part of their circumferential or envelope surface into the region of the folding boxes 10 and grip a lateral edge region of the respective front folding box 10. During the removal of this front folding box 10 a slight curvature of the latter occurs, whilst the lateral edges are carried past the holding rollers 21, 22, with a rotation of the latter, so that the folding box comes clear.

The supply 18 of folding boxes 10 is conveyed onwards in the magazine 19 rhythmically towards the removal side namely as dictated by the removal. For this purpose conveyor belts 25 are arranged in the region of each of the strip-shaped box supports 20, on the upper sides 26 of which the folding boxes 10 stand. The upper side 26 is braced by the associated box support 20. The latter protrudes with a prolongation 27 past a front return roller 28 of the conveyor belts 25. The rhythmic drive of the conveyor belts 25 occurs by a horizontally and/or vertically reciprocating pivoting movement of a drive lever 29, which influences the return roller 28. The latter is equipped with a freewheel transmission 30, so that drive movements are transmitted to the return roller 28, and therefore to the conveyor belt 25, in one direction only.

In the present exemplary embodiment a box erector 31 is arranged beneath, and staggered forwards in the transport direction relative to, the magazine 19. In the present case it is arranged at the start of a discharge path 32 for the erected and possibly filled folding boxes 10.

The box erector 31 consists of a first holding member in the form of a gripping arm 33. The latter serves to grip the respective front folding box 10 ih the magazine 19, namely in the region of the forward facing front wall 12. The gripping arm 33 is equipped for this purpose with a plurality of gripping members in the form of suction cups 34 arranged at a mutual interval. The latter are in turn connected by a common suction duct 35 and a flexible suction pipe (suction hose 36) not shown in detail, to a vacuum source. The folding box 10 is gripped by the suction cups 34 in the region of the front wall 12 so that the folding box is drawn out of the magazine 19 and entrained in the case of a corresponding movement of the gripping arm 33.

The gripping arm 33 has on the one hand the function to transport the folding box 10 from the magazine 19 onto the discharge path 32, and furthermore to effect the erection in cooperation with a second further holding member 37. The latter is arranged above the discharge path 32 so that, in the case of the corresponding relative position of the folding box removed from the magazine 19, the (lower) side wall 14 adjacent to the front wall 12 is gripped by suction cups 38. The second holding member 37 is arranged (stationary) so that the suction cups 38 extend in a vertical or approximately vertical plane. Accordingly, when the folding box 10 is fixed to the second holding membery 37, the associated side wall 14 extends in a vertical plane.

The sequence of operation of the erection of the box is therefore that the side wall 14 is fixed by the vertical holding member 37, whereas by a corresponding movement, namely by pivoting the gripping arm 33, the remaining part of the folding box passes downwards and therefore into an erected position (see FIGS. 6 and 7). The (flat) folding box, after removal from the magazine 19, is first of all brought by the gripping arm 33 into an intermediate position according to FIG. 5, in which a folding edge 39 pointing downwards between front wall 12 and side wall 14 stands on the fixed support, namely on the discharge path 32. The flat folding box is then aligned vertically or at right angles to the discharge path 32. At the end of the erection of the box the folding box rests with the front wall 12 on the discharge path, ready for filling and/or ready for transport. After the release of the holding members (gripping arm 33 and holder 37) the folding box 10 can be transported away. In the present exemplary embodiment (FIG. 7) a chain conveyor, which grips the folding box 10 on the rear side (side wall 14) by a driver 40, is effective in the region of the discharge path 32. In the exemplary embodiment illustrated here, the folding box 10 has previously been filled by pushing a corresponding group of cigarette bars 11 in the folding box 10 which is open at the side.

The gripping arm 33, a plurality of which may also be arranged juxtaposed in the case of a correspondingly large or wide folding box 10, is moved by a transmission which permits a translatory movement and a pivoting movement. In order to perform their functions the gripping arm 33 is moved out of the initial position according to FIG. 1, in which the suction cups 34 are located in and/or below the plane of the discharge path 32, in a pivoting sense in the direction of the arrows 41. The gripping arm 33 is simultaneously raised somewhat. Via the position illustrated in FIG. 2, the gripping arm finally passes into a substantially vertical or/ inclined accepting position according to FIG. 3, in which the suction cups 34 come into abutment with the front wall 12 of the front folding box 10.

The gripping arm 33 is now moved in a translatory (parallel) movement into the position according to FIG. 4. Gripping arm 33 and folding box 10 now occupy a position parallel to that according to FIG. 3, but lowered so that the folding edge 39 comes into abutment with the support (discharge path 32). The folding box 10 is then moved by pivoting and slight displacement sliding into an upright position according to FIG. 5, and the side wall 14 is simultaneously brought into abutment with the suction cups 38 of the holder 37. The pivoting movement of the gripping arm 33 in order to erect the folding box 10, already described, then follows. The pivotal movement is then accomplished into the position according to FIG. 7, in which the suction cups 34 are located at an interval below the discharge path 32, so that they are clear of the front wall 12 of the folding box 10.

For this purpose the gripping arm 33 is supported and actuated by two guide rods 42 and 43 constructed as two-armed levers. The two guide rods 42 and 43 are associated with a common pivot bearing, in the present case so that guide rod arms 44 and 45 of the guide rod 42 are connected to a main shaft 46, whereas guide rod arms 47 and 48 are mounted for rotation on this main shaft 46. The guide rod arms 47 and 48 are mutually connected for this purpose by a rotary sleeve 49 mounted on the main shaft 46. The guide rod arm 44 is connected directly and via a pivot bearing 50 to a lateral lug 51 of the gripping arm 33. The guide rod 43 or the guide rod arm 48 influences the gripping arm 33 via a guide rod stem 52. The guide rod stem 52 is connected to the gripping arm 33 in the region of a pivot bearing 53. The pivot bearings 50 and 53 are located at a mutual interval, so that in the case of a different actuation of the guide rods 42 and 43 a pivoting moment can be transmitted to the gripping arm 33. The guide rod arms 45 and 47 are respectively connected to actuating stems 54 and 55, which can be actuated in the one or other direction by disc cams (not shown) for example.

By means of an appropriate control system, any required movement can be transmitted to the gripping arm through the above-described transmission.

The holder 37 is likewise movable with a small amplitude in order to permit adaptation to the positions of the folding box 10. For this purpose the holder 37 is attached laterally to a vertical support bar 56, which is rotatable about its vertical axis. Rotary movements of the support bar 56, and therefore forward and return movements of the holder 37, can be executed via a tappet 57, which is driven by a disc cam or a pressurised medium member for example.

The discharge path 32 in the present exemplary embodiment is likewise of special construction, namely it consists of a central hollow profile 58, on the top side of which the folding boxes 10 rest. In the movement region of the gripping arm 33 the hollow profile 58 is provided with a recess 59, which the gripping arm 33 enters when depositing the folding box upon the discharge path.

Support rails, 60 for the laterally projecting folding tabs 16 and 17 are arranged at an interval laterally of the hollow profile 58.

I claim:

1. Apparatus for erecting flat folding boxes each of which has a front wall, a rear wall, two side walls and folding tabs adjoining the latter, said apparatus comprising:

a magazine defined by means for holding a substantially horizontal stack of a plurality of said flat boxes disposed in substantially vertical planes;

a substantially horizontal discharge path, disposed below said magazine, defined by means for discharging erected boxes;

a single pivotable and translatable elongated gripper arm means (33) having an initial position at or below said horizontal discharge path and having first suction means (34) for engaging and holding the front wall of a first flat box in said magazine;

stationary holder means (37) carrying second suction means (38) for holding a side wall of said flat box and being disposed between said magazine and said discharge path;

link means, including two guide rods (42, 43) and coupled to one end of said gripper arm means, for pivoting said gripper arm means upwardly out of said initial position so that said first suction means (34) engages and holds the front wall of a first flat box in said magazine, for translating said gripper arm means vertically downward until a lower folding edge of said first flat box is supported on said discharge path (32), and for then pivoting said gripper arm means until the held box abuts said stationary holder means and said second suction means holds a side wall of said flat box, and for then pivoting said gripper arm means downwardly toward said initial position so that said flat box is erected.

2. Apparatus according to claim 1, further comprising a main shaft (46), and wherein the guide rods (42, 43) comprise two-armed levers which actuate said gripping arm means, one guide rod (42) being fixed to the main shaft (46) and the other guide rod (43) being mounted rotatably thereon.

3. Apparatus according to claim 1, comprising means, associated with said stationary holder means (37), for rotatably adjusting said stationary holder means (37) about a vertical axis to adapt to different positions of the flat box held by said gripping arm means (33).

4. Apparatus according to claim 1, wherein the discharge path (32) consists of at least one supporting hollow profile (58) with a standing surface for the boxes (10) and with a recess (59), whereby the gripping arm means (33) can be lowered into the recess (59) of the hollow profile (58).

5. Apparatus according to claim 4 further comprising support rails (60), disposed at an interval from the hollow profile (58), to support the folding tabs (16 and 17) which stand out laterally.

6. Apparatus according to claim 1, wherein said magazine (19) holds the flat folding boxes (10) in a substantially upright position with a slight inclination in the transport direction of said discharge path.

7. Apparatus according to claim 6, wherein said magazine comprises box supports (20) on which the folding boxes (10) stand up in the magazine (19), said supports providing a foundation inclined downwards in the transport direction, and further comprising conveyor belt means (25) for producing rhythmic feed of the folding boxes (10) within the magazine (19).

8. Apparatus according to claim 7, wherein the conveyor belt means (25) comprises a return roller (28), a free wheel transmission (30), and a reciprocally pivotable drive lever (29) which influences the return roller (28) via the free wheel transmission (30).

9. Apparatus according to claim 1, wherein said magazine comprises holding roller means (21, 22), rotatable about vertical axes and gripping an edge of the folding boxes (10) at opposite sides, for detachably fixing the boxes on a magazine end which said gripping arm means abuts.

* * * * *